US005615610A

United States Patent [19]

Prohaska

[11] Patent Number: 5,615,610

[45] Date of Patent: Apr. 1, 1997

[54] WEB CAPTURING DEVICE

[75] Inventor: Stefan Prohaska, Frankenthal, Germany

[73] Assignee: Koenig & Bauer-Albert Aktiengesellschaft, Wurzburg, Germany

[21] Appl. No.: 610,259

[22] Filed: Mar. 4, 1996

[30] Foreign Application Priority Data

Mar. 14, 1995 [DE] Germany ..... 195 09 167.1

[51] Int. Cl.[6] ..... B41F 3/44

[52] U.S. Cl. ..... 101/253; 101/219; 226/11

[58] Field of Search ..... 101/253, 288, 101/424.1, 228, 219; 226/187, 196, 11, 191, 197; 242/419.3, 615.3

[56] References Cited

U.S. PATENT DOCUMENTS

| | | | |
|---|---|---|---|
| 4,549,485 | 10/1985 | Nawrath | 101/219 |
| 4,846,060 | 7/1989 | Proctor | 101/228 |
| 5,036,765 | 8/1991 | Keilhau | 101/228 |
| 5,190,201 | 3/1993 | Briggs | 26/1 |
| 5,372,290 | 12/1994 | Marmin . | |
| 5,398,610 | 3/1995 | Pavliny et al. . | |
| 5,443,008 | 8/1995 | Pavliny et al. . | |

FOREIGN PATENT DOCUMENTS

| | | |
|---|---|---|
| 0563645 | 10/1993 | European Pat. Off. . |
| 0575786 | 12/1993 | European Pat. Off. . |
| 0616966 | 9/1994 | European Pat. Off. . |
| 2519298 | 7/1983 | France . |
| 2156505 | 2/1973 | Germany . |
| 2818832 | 2/1986 | Germany . |

OTHER PUBLICATIONS

Patent Abstracts Of Japan; No. JP-A-02 222946; Nov. 1990; vol. 14; No. 529.

*Primary Examiner*—Edgar S. Burr
*Assistant Examiner*—Dave A. Ghatt
*Attorney, Agent, or Firm*—Jones, Tullar & Cooper, P.C.

[57] ABSTRACT

A web capturing device is provided with two cooperating web capture rollers which define a capture gap through which a web passes. The capture gap spacing is made as small as possible by the utilization of a web stabilizing assembly that eliminates fluttering and vibration in the web. This web stabilizer is formed by two generally parallel stabilizer plates that define a clearance space through which the web passes.

6 Claims, 1 Drawing Sheet

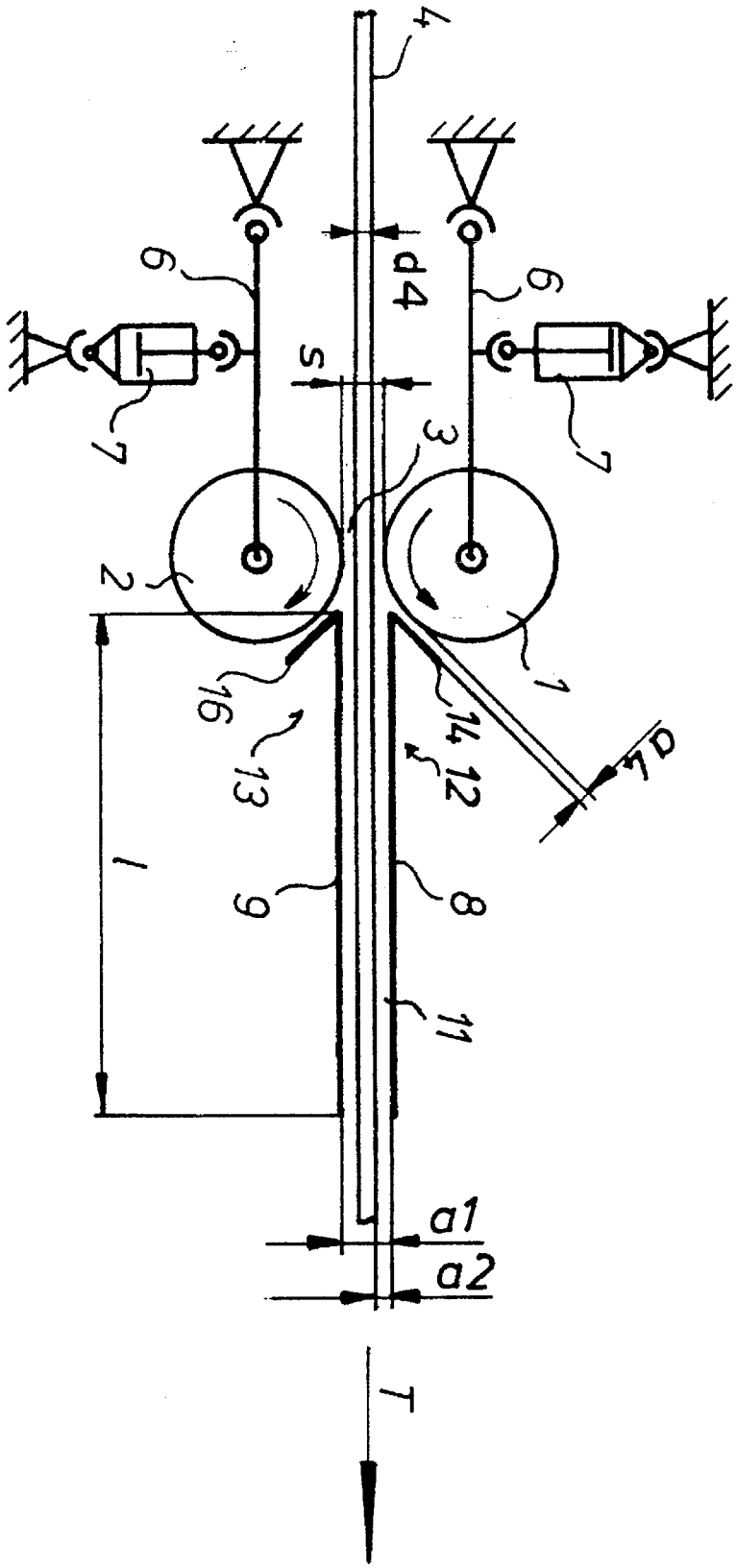
4
d4
s
6
6
7
7
3
2
1
16
14
12
13
d4
l
9
8
11
a1
a2
T

WEB CAPTURING DEVICE

FIELD OF THE INVENTION

The present invention is directed generally to a web capturing device. More particularly, the present invention is directed to a web capturing device in a printing unit. Most specifically, the present invention is directed to a web capturing device for the selective gripping of a web in a web fed printing press. Two spaced apart capture elements, which are preferably driven capture rollers, form a capture gap through which the web normally passes. If a break or tear in the web is sensed, the capture elements will engage the web and will prevent it from winding up on one of the rollers or cylinders of the press. A pair of web stabilizing plates are positioned adjacent the capture gap and form a web stabilizer. The web is guided between the spaced web stabilizing plates and an air cushion is created between the plates. This air cushion acts to stabilize the web and to decrease fluttering or vibrating of the web which allows the capture gap to be made relatively small.

DESCRIPTION OF THE PRIOR ART

In web-fed printing presses, it is not unusual for the web to tear or break as it passes between various spaced components of the press. Such a web tear or break is potentially very damaging since the break or tear of the web will eliminate the tension in the web and thus can result in a wrapping or winding up of the web on one of the press cylinders or rollers. Such a web wind up will increase the effective diameter of the cylinder or roller about which the web becomes wound and can quickly result in damage to the cylinder or roller, to its support journals or bearings, or possibly to the frame of the press.

Various sensors and web guides and rollers are generally known in the art whose purpose is to prevent such web wrap-up in case of a web break or tear. German Letters Patent No. 2 156 505 shows one such device that is usable for the prevention of damage to a printing unit in the case of a paper web tear or break. In this prior art device, a pair of rollers are provided and are used to grip the paper web in case of a web tear or break. During the normal operation of the printing unit, these web capture gripping rollers are separated from each other and define a capture gap through which the paper web passes. It is important that the web not contact either one of the web capture gripping rollers as it passes through the capture gap during normal press operations. Such a contact would be likely to smear the printing on the web or could cause a frictional drag that might result in web tearing or breakage.

As the web travels between components in a printing press, it may travel over relatively long distances with no intermediate support. Such unsupported web travel is apt to result in fluttering or vibration of the web over its extended, unsupported length. One such unsupported, elongated travel distance may be between the exit of the web from the last printing couple, and the entrance of the web into a web dryer. In the prior art web capture devices, the capture gap between the spaced capture elements must be made quite wide so that the freshly printed web will not contact either of the capture elements during its fluttering or vibration. The provision of such a wide capture gap between the capture elements, such as two spaced capture rollers, means that the prior art web capture device is inherently slow to react to a broken or torn web and slow to capture the web. Such a slow reaction time can result in press damage.

It will be apparent that a need exists for an apparatus which will overcomes the limitations of the prior art devices. The web capturing device in accordance with the present invention provides such an apparatus and is a significant advance over the prior art.

SUMMARY OF THE INVENTION

It is an object of the present invention to provide a web capturing device.

Another object of the present invention is to provide a web capturing device in a printing unit.

A further object of the present invention is to provide a web capturing device for the selective gripping of a web in a web-fed printing apparatus.

Still another object of the present invention is to provide a web capturing device having two spaced capture elements.

Yet a further object of the present invention is to provide a web capturing device which minimizes web fluttering or vibration in the area of the capture elements.

As will be set forth in detail in the description of the preferred embodiment, which is presented subsequently, the web capturing device in accordance with the present invention utilizes two spaced apart capture elements that form a capture gap. The web passes through this capture gap. At least one of the capture elements is movable so that it can be brought into functional contact with the second capture element if a tear or break in the web is sensed. A web stabilizing assembly, in the form of two spaced stabilizer plates, is situated adjacent the web capture gap. These two stabilizer plates are generally parallel to each other and to the plane of the web. The spacing between the plates is greater than the thickness of the web. As the web passes through the web stabilizer, it creates a cushion of air between the two plates and the two surfaces of the web. This cushion of air has the effect of substantially reducing web fluttering or vibration in the area of the capture gap.

A significant advantage of the web capturing device in accordance with the present invention resides in the ability of the web stabilizer to facilitate the travel of the web through the web capture gap in a much more stable manner. This means that fluttering or vibration of the web, which in the past has occurred particularly in connection with extended free length of travel of the web between two web gripping points, such as between two spaced-apart printing units, or between the last printing unit and a subsequent dryer for a web-fed rotary printing unit, will be substantially reduced. The use of the web stabilizer in the web capturing device of the present invention eliminates the need for additional, energy consuming devices, such as air nozzles, which have been used previously to steady the web. A web stabilizing or steadying air cushion is automatically formed as the web passes between the sheet metal plates of the web stabilizer which is situated adjacent the web capture gap. Because the web is caused to run in a much quieter, more stable manner in the area of the web capture gap of the present invention, the spacing between the capturing elements can be made much less to thereby minimize the size of the web capture gap. This results in a shortened reaction time between the sensing of the breakage of the web and the resultant initiation of movement of at least one of the capture elements, and the time when the web is securely gripped by the web capture elements. Clearly if this reaction time can be shortened, the operational dependability of the web-fed rotary printing press will be further increased, even in spite of higher permissible web speeds.

The web capturing device in accordance with the present invention overcomes the limitations of the prior art. It is a substantial advance in the art.

BRIEF DESCRIPTION OF THE DRAWINGS

While the novel features of the web capturing device in accordance with the present invention are set forth with particularity in the appended claims, a full and complete understanding of the invention may be had by referring to the detailed description of the preferred embodiment which is presented subsequently, and as illustrated in the sole drawing FIGURE which is a schematic side view of a web capturing device in accordance with the present invention.

DETAILED DESCRIPTION OF THE PREFERRED EMBODIMENT

Referring now to the sole drawing FIGURE, there may be seen a web capturing device in accordance with the present invention. The web capturing device depicted in the sole drawing FIGURE is preferably, but not exclusively, intended to be located in a web-fed printing press apparatus in the path of travel of a web. Preferably, the web capturing device is located between a printing unit and a dryer which is located downstream from the printing unit in the direction of web travel T. The printing press is typically a generally conventional web-fed rotary printing press. Since it forms no part of the present invention, it will not be discussed in detail.

The web capturing device depicted in the sole drawing FIGURE utilizes spaced first and second web capture elements 1 and 2. Preferably these capture elements are first and second spaced web capture rollers 1 and 2. These capture rollers 1 and 2 cooperate to operate as a pair of web gripping rollers. These two web capture rollers 1 and 2 are supported with their respective axes of rotation generally parallel to each other and generally transverse to the direction of web travel T. The two web capture rollers 1 and 2 are spaced apart from each other and cooperate to form a web capture gap 3. This capture gap 3 has a separation or width "s" of generally, for example, 20 mm; i.e. s=20 mm. A web 4, having a web thickness d4 of, for example, 0.05 mm; i.e. d4=0.05 mm is guided through the capture gap 3. At least one of the first and second web capture rollers 1 and 2 is supported for movement into functional engagement with the other of the two web capture rollers to effect the selective gripping of the web 4. As may be seen in the drawing, each of the web gripping rollers 1 and 2 is supported at a first end of a pivot lever or pivot arm 6 whose second end is pivotably attached to the frame of the printing press. Suitable pneumatic or hydraulic cylinders 7 are used to shift at least one of the web gripping rollers 1 or 2 into cooperative engagement with the other roller upon the sensing of a break or a tear in the web 4 by a typical web break sensor which is not specifically depicted. Both of the web capture rollers 1 and 2 can be independently driven at web travel speed by capture roller drives which are not specifically depicted.

A web stabilizer is positioned adjacent the web capture rollers 1 and 2. In the sole drawing FIGURE, this web stabilizer is depicted as being situated downstream of the web capture rollers 1 and 2 in the direction of travel T of the web 4. The web stabilizer is comprised of first and second stabilizer plates 8 and 9 which are depicted as being positioned respectively above and below the web 4. These upper and lower plates 8 and 9 have first plate ends 12 and 13 which are spaced downstream from the rollers 1 and 2 at a short spacing distance a4 of, for example, 3 mm; i.e. a4=3 mm. These two stabilizer plates 8 and 9 are generally parallel to each other and are generally parallel to the planar surfaces of the web 4. Each of the stabilizer plates 8 and 9 has a width which is at least as great as the maximum width of the web 4 and a length "l" of, for example, 200 mm; i.e. "l"=200 mm. The two stabilizer plates 8 and 9 may be fastened, either securely or adjustably in the spaced side frames of the printing press and are spaced apart from each other at a plate spacing distance al of, for example 30 mm; i.e. a1=30 mm. The stabilizer plates 8 and 9 are each preferably approximately 10 mm wider than the width of the web 4.

A clearance 11 is defined by the spaced stabilizer plates 8 and 9. The web 4 passes through this clearance 11 and is preferably centered between the spaced stabilizer plates 8 and 9. This means that a spacing distance a2 from either the top stabilizer plate 8 or the bottom stabilizer plate 9 to the surface of web 4 is approximately half of the stabilizer plate spacing distance al; i.e. a2=0.5×a1. At their respective first ends 12 and 13, which are adjacent the capture gap 3 formed by the web capture rollers 1 and 2, the stabilizer plates 8 and 9 are provided with beveled or flanged edges or ends 14 and 16, respectively. These flanged ends 14 and 16 extend outwardly away from their respective plate first ends 12 and 14 and are angled at an acute angle generally in the direction of web travel T. The beveled or angled leading edges of flanges 14 and 16 of the spaced stabilizer plates 8 and 9 assist in creating an improved airflow into the clearance 11 between the plates 8 and 9. This air is carried into the clearance 11 by the passage of the web 4 between the stabilizer plates 8 and 9. The beveled or flanged edges or ends 14 and 16 of the stabilizer plates 8 and 9 also facilitate insertion of the web 4 between the plates.

In accordance with the present invention, the plate spacing distance al can be a constant along the length "l" of the plates. Alternatively, this plate spacing distance al can be slightly greater at the first entrance ends 12 and 13 of the plates 8 and 9 than at the second, exit ends of the plates 8 and 9. This will provide the clearance space 11 with a slightly reducing cross-section in the direction of travel T of the web 4. The two stabilizer plates 8 and 9 can also be provided with lateral or side plates so that the result is a closed guide channel for the web 4. This guide channel would be closed on all four sides and open at only the inlet and outlet ends for passage of the web 4. In accordance with the present invention, it would also be possible to provide a second pair of stabilizer plates 8 and 9 upstream of the pair of capture rollers 1 and 2. These upstream stabilizer plates 8 and 9 would be a mirror image of the downstream stabilizer plates 8 and 9 which are depicted in the sole drawing FIGURE. It would further be possible to provide only the upstream stabilizer plates 8 and 9 instead of the downstream stabilizer plates 8 and 9.

In the operation of the rotary printing press, it is important to make the spacing distance "s" of the capture gap 3 as small as possible while still allowing the printed web 4 to pass between the capture rollers 1 and 2 in a contactless manner. The capture gap spacing distance "s" is less than the clearance space 11 between the two stabilizer plates 8 and 9. The spacing distance "s" of the capture gap 3 should be made as small as possible so that the application time of the capture rollers 1 and 2 can be as short as possible. These capture rollers 1 and 2 are produced in lightweight construction and are moved into operational contact in the event of a web tear or break. The web 4 is guided approximately in the center of the capture gap 3 and in the center of the clearance space 11 between the stabilizer plates 8 and 9. As indicated above, the spacing "s" of the capture gap 3 is preferably less than the distance al between the plates 8 and 9. The air cushion which is automatically formed between the web 4 and the upper and lower plates 8 and 9 stabilizes the web 4 as it passes through the stabilizer. This air cushion effectively eliminates or greatly reduces fluttering and vibrations of the web 4 in the stabilizing device and thus also in the area of the capture rollers 1 and 2. Since the passage of the web 4 through the capture gap 3 can be accomplished in a quiet, smooth manner, the width "s" of the capture gap 3 can be made very small.

During a normal printing operation if a web tear or a web break occurs, it is sensed by an appropriate sensor. This sensor then actuates one or both of the pneumatic cylinders 7 to bring the capture rollers 1 and 2 into functional engagement with the web 4. These two capture rollers 1 and 2 securely grip the web 4 and prevent any web wrap up on one of the printing cylinders or other press cylinders. Since the capture gap width "s" of the capture gap 3 can be maintained at a minimum distance due to the ability of the stabilizer plates 8 and 9 to prevent the web 4 from fluttering or vibrating, the response time of the web capturing device is as rapid as possible.

The stabilizer plates 8 and 9 are depicted in the sole drawing FIGURE as being planar, generally parallel plates. Alternatively, the stabilizers 8 and 9 could have an aerodynamically advantageous profile shape. For example, these stabilizers 8 and 9 could each have a wing shape which would act to form a stabilizing cushion of air between the two stabilizer 8 and 9 so that the web 4 would be held in a steady position free from flutter and vibration.

While a preferred embodiment of a web capturing device in accordance with the present invention have been set forth fully and completely hereinabove, it will be apparent to one of skill in the art that a number of changes in, for example, the type of printing press, the drive means for the rollers, the type of web being used, and the like could be made without departing from the true spirit and scope of the present invention which is accordingly to be limited only by the following claims.

What is claimed is:

1. A web capturing device usable in a printing press comprising:

first and second spaced web capture elements forming a capture gap for a web passing through said capture gap, said web having a web thickness;

means for moving said capture elements into cooperative engagement for the selective gripping of said web in said capture gap; and a web stabilizing device having first and second stabilizer plates positioned adjacent said web capture elements said first and second stabilizer plates being disposed generally parallel to each other at a plate spacing distance which is greater than said web thickness.

2. The web capturing device of claim 1 wherein said first and second stabilizer plates have first ends adjacent said capture gap and second ends remote from said capture gap and further wherein said plate spacing distance is greater at said first ends than at said second ends.

3. The web capturing device of claim 1 wherein said first and second stabilizer plates further have lateral plates.

4. The web capturing device of claim 1 wherein said plate spacing distance is adjustable in a direction generally perpendicular to said web.

5. The web capturing device of claim 1 wherein said first and second web capture elements are rollers.

6. The web capturing device of claim 5 further including means to drive said rollers.

* * * * *